US010450102B2

(12) United States Patent
Sumitomo

(10) Patent No.: US 10,450,102 B2
(45) Date of Patent: Oct. 22, 2019

(54) PACKAGING BOX AND PACKAGING FORM OF TONER CARTRIDGE

(71) Applicant: KYOCERA Document Solutions Inc., Osaka (JP)

(72) Inventor: Seiji Sumitomo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/921,155

(22) Filed: Mar. 14, 2018

(65) Prior Publication Data

US 2018/0265245 A1 Sep. 20, 2018

(30) Foreign Application Priority Data

Mar. 16, 2017 (JP) ..... 2017-051845

(51) Int. Cl.

| | |
|---|---|
| ***B65D 81/02*** | (2006.01) |
| ***B65D 5/42*** | (2006.01) |
| ***B65D 81/03*** | (2006.01) |
| ***G03G 15/08*** | (2006.01) |
| ***B65D 5/54*** | (2006.01) |
| ***B65D 85/30*** | (2006.01) |
| ***B65D 77/04*** | (2006.01) |
| ***B65D 5/02*** | (2006.01) |
| ***B65D 5/50*** | (2006.01) |
| ***G03G 21/18*** | (2006.01) |
| *B65D 5/10* | (2006.01) |

(52) U.S. Cl.

CPC ..... *B65D 5/4204* (2013.01); *B65D 5/0227* (2013.01); *B65D 5/5007* (2013.01); *B65D 5/5088* (2013.01); *B65D 5/541* (2013.01); *B65D 77/042* (2013.01); *B65D 81/03* (2013.01); *B65D 85/30* (2013.01); *G03G 15/0865* (2013.01); *G03G 15/0896* (2013.01); *G03G 21/181* (2013.01); *B65D 5/106* (2013.01); *B65D 2577/047* (2013.01); *B65D 2585/689* (2013.01)

(58) Field of Classification Search

CPC .. B65D 5/4204; B65D 5/0227; B65D 5/5007; B65D 5/5088; B65D 5/541

USPC ..... 206/446

See application file for complete search history.

(56) References Cited

U.S. PATENT DOCUMENTS 1,253,489 A * 1/1918 Houghland ..... B65D 5/38 229/125.125

2017/0225474 A1 8/2017 Arimura

FOREIGN PATENT DOCUMENTS

| | | |
|---|---|---|
| CN | 107053856 | 10/2018 |
| JP | 2011-230824 | 11/2011 |

* cited by examiner

*Primary Examiner* — King M Chu

(74) *Attorney, Agent, or Firm* — Wenderoth, Lind & Ponanck, L.L.P.

(57) ABSTRACT

A packaging box includes a bending piece provided at an end part of the other end side of a tubular side plate of the packaging box, and pressed while being surrounded by a breakable line and a bending line so as to be broken and bent to the inside of the box along the breakable line. In the bending state, the bending piece is configured such that its distal end part is positioned at the other end side from a receiving area of an object to be packaged and inhibits movement of the object to be packaged to the other end side.

3 Claims, 8 Drawing Sheets

PACKAGING BOX AND PACKAGING FORM OF TONER CARTRIDGE

CROSS-REFERENCE TO RELATED APPLICATION

This application is based upon and claims the benefit of priority from Japanese Patent Application No. 2017-051845 filed on Mar. 16, 2017, the entire contents of which are incorporated herein by reference.

BACKGROUND

The technology of the present disclosure relates to a packaging box and a packaging form of a toner cartridge.

In the related art, there has been known a packaging box that individually receives products. The packaging box has a tubular side plate for covering a side surface of a product (an object to be packaged), one end side-blocking plate for blocking one end side opening of the tubular side plate, and the other end side-blocking plate for blocking the other end side opening.

SUMMARY

A packaging box according to one aspect of the present disclosure includes a tubular side plate, one end side-blocking plate, and the other end side-blocking plate. The tubular side plate covers a periphery of an object to be packaged. The one end side-blocking plate blocks an opening of one end side, which constitutes an outlet of the object to be packaged in the tubular side plate. The other end side-blocking plate blocks an opening of the other end side opposite to the one end side.

A bending piece is provided at an end part of the aforementioned other end side of the aforementioned tubular side plate. The bending piece is surrounded by a breakable line and a bending line. The bending piece is pressed to be broken and bent to the inside of the box along the breakable line. In the bending state, the bending piece is configured such that its distal end part is positioned at the aforementioned other end side from a receiving area of the aforementioned object to be packaged and inhibits movement of the object to be packaged to the other end side.

DETAILED DESCRIPTION

Hereinafter, an example of an embodiment will be described in detail on the basis of the drawings. It is noted that the technology of the present disclosure is not limited to the following embodiment.

<<Embodiment>>

Figure 1:
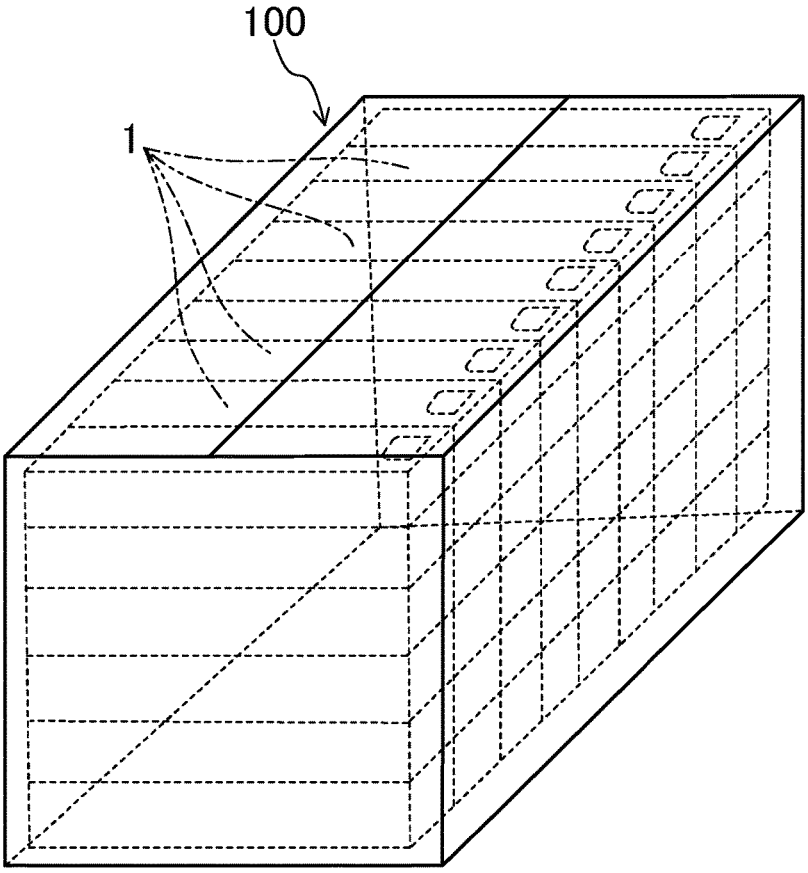
FIG. 1 is a schematic diagram illustrating a state in which a packaging box of an embodiment is stacked in plural stages and is received in one assembly box.

FIG. 1 is a schematic diagram illustrating a state in which a packaging box 1 of an embodiment is received in an assembly box 100. The packaging box 1 is an individual packaging box in which an object to be packaged (a toner cartridge 20 in the present embodiment) is individually packaged. The packaging box 1 forms a rectangular parallelepiped shape long in a predetermined direction in appearance (see FIG. 2). In the assembly box 100, a plurality of packaging boxes 1 are received adjacent to one another without a gap. The packaging box 1 and the assembly box 100 are formed by bending a corrugated cardboard sheet punched in a predetermined shape.

Figure 3:
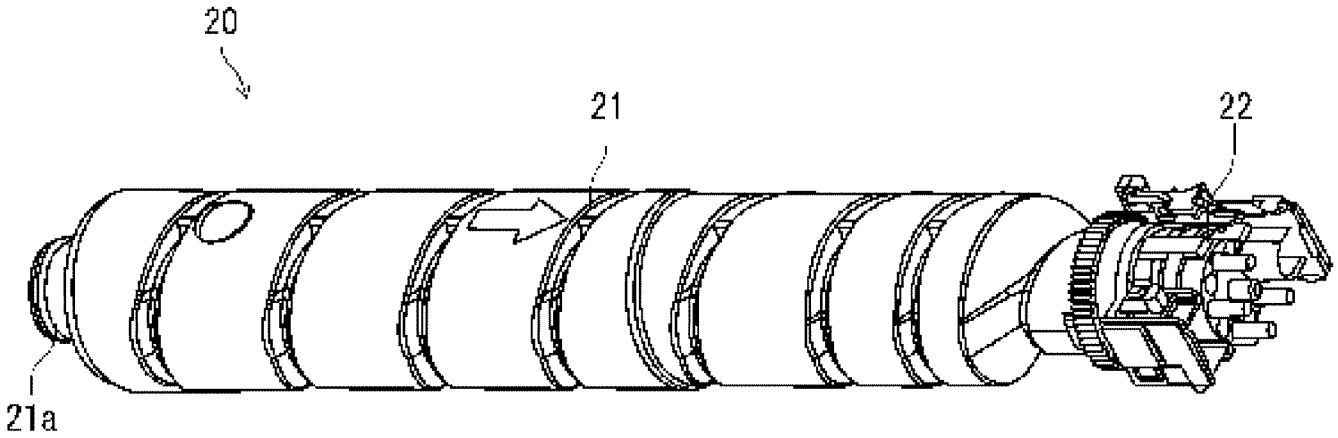
FIG. 3 is an external appearance perspective view illustrating a product packaged in a packaging box.

FIG. 3 illustrates the toner cartridge 20 (an example of the object to be packaged) packaged by the packaging box 1. The toner cartridge 20 is mounted at an image forming apparatus as a part for storing printing toner. The toner cartridge 20 has a toner case 21 and a driving connection part 22. The toner case 21 is a hollow cylindrical case extending in a predetermined direction. The toner case 21 is provided therein with a stirring screw that stirs toner stored in the toner case 21. At one side end part in a longitudinal direction of the toner case 21, a handle part 21*a* having a diameter smaller than that of the toner case 21 is formed. The driving connection part 22 is provided at the other side end part in the longitudinal direction of the toner case 21. The toner cartridge 20 is mounted at the image forming apparatus by sliding in the longitudinal direction from the driving connection part 22 side. When the toner case 21 is mounted at the image forming apparatus, the driving connection part 22 is connected to a motor serving as a driving source and transmits rotational driving force of the motor to the stirring screw.

Figure 2:
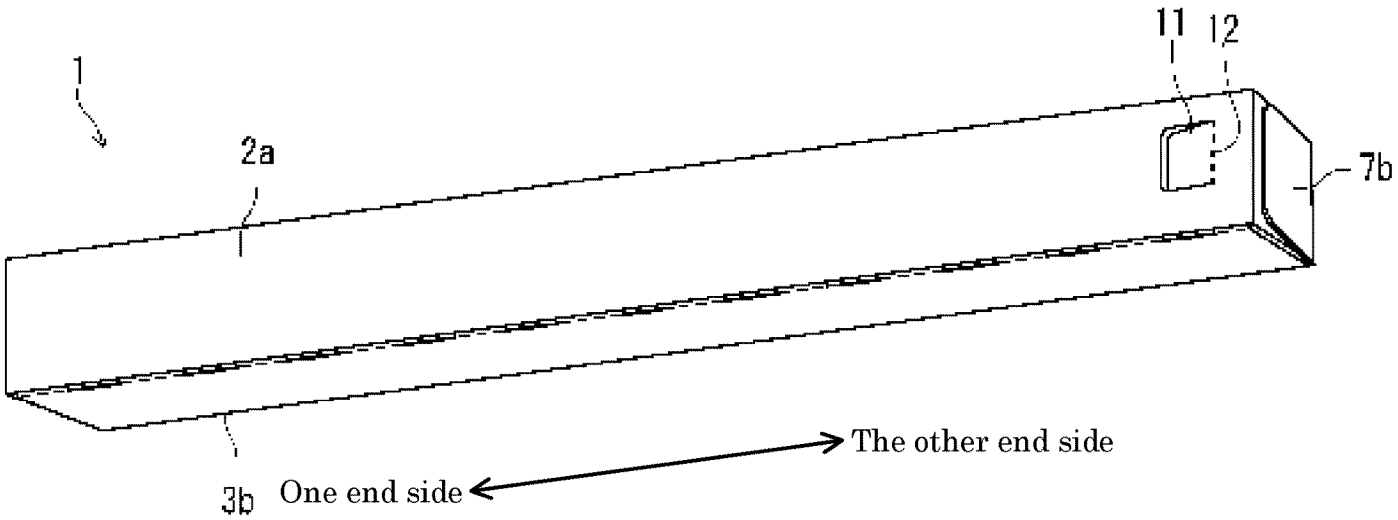
FIG. 2 is an external appearance perspective view illustrating a packaging box.
Figure 4:
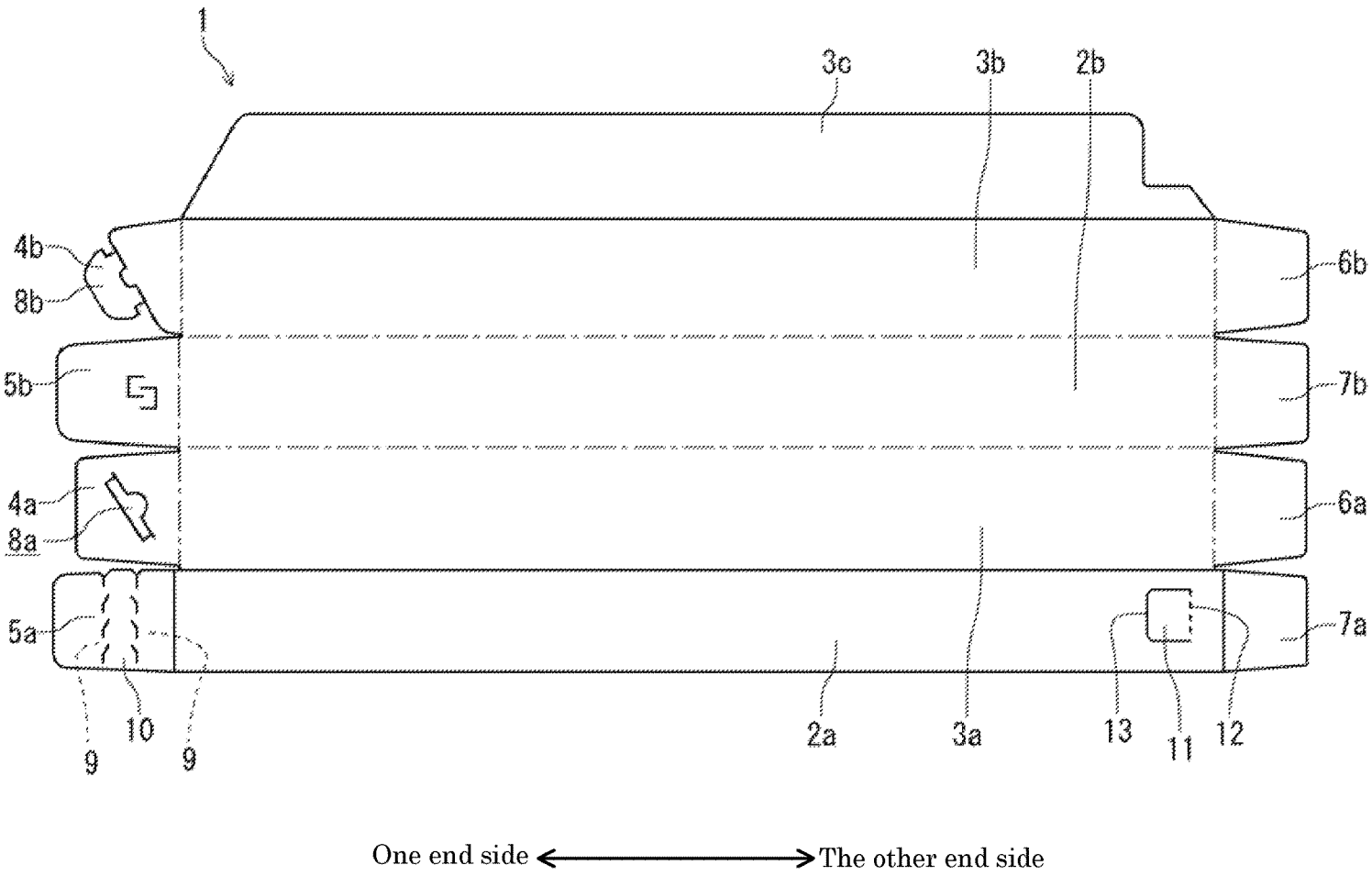
FIG. 4 is a development view of a packaging box.

As illustrated in FIG. 2 and FIG. 4, the packaging box 1 has a pair of first side plates 2*a* and 2*b* and a pair of second side plates 3*a* and 3*b* extending in the longitudinal direction, cover plates 5*a* and 5*b* and cover plates 7*a* and 7*b*, flaps 4*a* and 4*b* and flaps 6*a* and 6*b*, and an adhesive piece 3*c*. The cover plates 5*a* and 5*b* and cover plates 7*a* and 7*b* are respectively concatenated to one side end edge and the other side end edge in the longitudinal direction of the first side plates 2*a* and 2*b* via bending lines. The flaps 4*a* and 4*b* and flaps 6*a* and 6*b* are respectively concatenated to one side end edge and the other side end edge in the longitudinal direction of the second side plates 3*a* and 3*b* via the bending lines. The adhesive piece 3*c* is provided to an end edge extending in the longitudinal direction of the second side plate 3*b* via a bending line.

At the flaps 4*a* and 4*b* concatenated to the one side end edge in the longitudinal direction of the second side plates 3*a* and 3*b*, a slit-like engagement hole 8*a* and a trapezoidal engagement piece 8*b* are formed. Furthermore, at one (the cover plate 5*a* in the present embodiment) of the cover plates 5*a* and 5*b* provided at the one side end part in the longitudinal direction, a pair of breakable lines 9 are formed to be parallel to each other, and a part interposed between the pair of breakable lines 9 serves as a belt-like part 10 for opening. Furthermore, at one (the first side plate 2*a* in the present embodiment) of the pair of first side plates 2*a* and 2*b*, a rectangular bending piece 11 is formed. Details of the bending piece 11 will be described later.

Next, both an assembly work of the packaging box 1 and a packaging work of the toner cartridge 20 into the packaging box 1 will be described. Firstly, the adhesive piece 3*c* concatenated to the second side plate 3*b* is overlapplingly bonded to an inner side of the first side plate 2*a*. In this way, the first side plates 2*a* and 2*b* and the second side plates 3*a* and 3*b* form side surfaces of the packaging box 1 in a tubular shape. The first side plates 2*a* and 2*b* and the second side plates 3*a* and 3*b* correspond to tubular side plates.

Next, the flap 4*a* and the flap 4*b* provided at one end part in the longitudinal direction of the packaging box 1 are bent in this order and the cover plate 5*b* and the cover plate 5*a* are bent in this order, so that a part positioned at a distal end side from the belt-like part 10 of the cover plate 5*a* is fixed to the cover plate 5*b* by using an adhesive. In this way, an opening (an outlet) positioned at one end side of the packaging box 1 is blocked. The flaps 4*a* and 4*b* and the cover plates 5*a* and 5*b* correspond to one end side-blocking plate.

In this state, the toner cartridge 20 is inserted into the packaging box 1. In this case, the direction of the toner cartridge 20 is set such that the driving connection part 22 side of the toner cartridge 20 is positioned at the other end side of the packaging box 1 and the handle part 21*a* side of the toner cartridge 20 is positioned at one end side of the packaging box 1.

After the toner cartridge 20 is inserted into the packaging box 1 by so doing, a bubble-containing buffer material 14 (see FIG. 7) is filled in the packaging box 1 from an opening positioned at the other end side of the packaging box 1. The bubble-containing buffer material 14 is filled in a space positioned at the other end side from a receiving area of the toner cartridge 20 in the packaging box 1. After the bubble-containing buffer material 14 is completely filled, the flaps 6*a* and 6*b* and the cover plates 7*a* and 7*b* provided at the other end side in the longitudinal direction of the packaging box 1 are bent in this order and are fixed using an adhesive. In this way, the opening positioned at the other end side of the packaging box 1 is blocked, so that assembly work and packaging work of the toner cartridge 20 are completed. The flaps 6*a* and 6*b* and the cover plates 7*a* and 7*b* correspond to the other end side-blocking plate. In the state in which the packaging of the toner cartridge 20 has been completed, the handle part 21*a* of the toner cartridge 20 faces the flaps 4*a* and 4*b* and the cover plates 5*a* and 5*b*, and the driving connection part 22 of the toner cartridge 20 faces the bubble-containing buffer material 14.

Then, a worker receives the packaging box 1 in the assembly box 100 such that the bending piece 11 formed at the first side plate 2*a* of the packaging box 1 is positioned at an upper surface (see FIG. 1).

Figure 5:
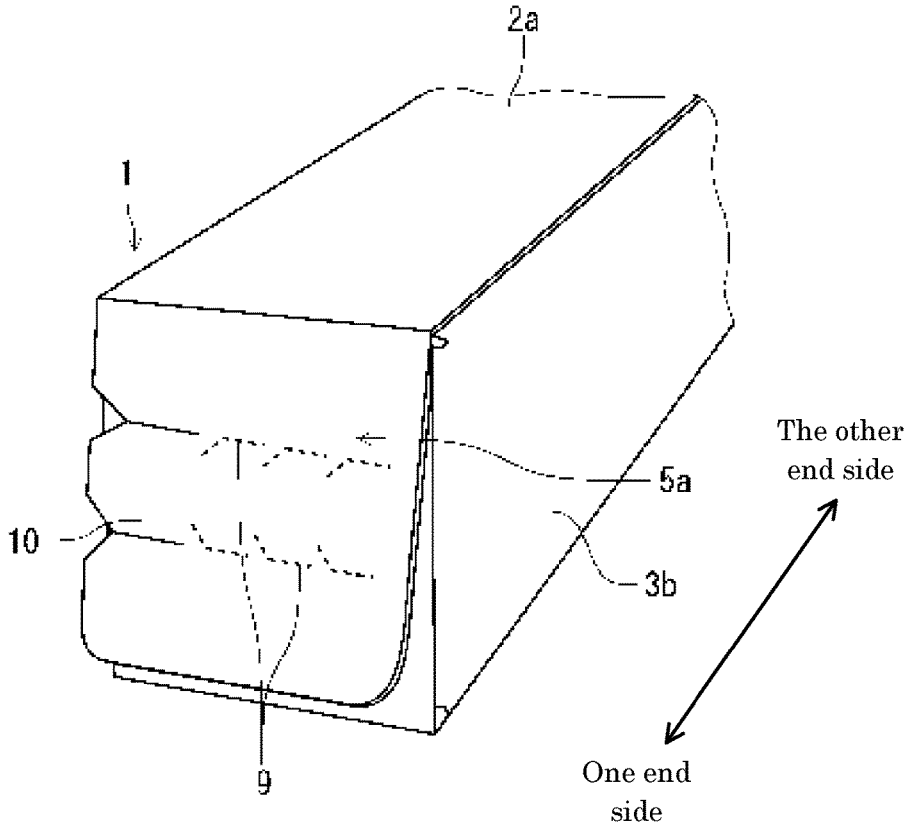
FIG. 5 is an enlarged perspective view illustrating one end part in a longitudinal direction of a packaging box.

When the toner cartridge 20 in the packaging box 1 is taken out, the cover plates 5*a* and 5*b* for blocking one end side in the longitudinal direction of the packaging box 1 are opened. Specifically, the belt-like part 10 (see FIG. 5) provided at the center part of the cover plate 5*a* is torn off along the pair of breakable lines 9 in a transverse direction, so that the cover plates 5*a* and 5*b* are separated from each other. Then, the separated cover plates 5*a* and 5*b* are bent to the outside of the packaging box 1. Thereafter, the flaps 4*a* and 4*b* (see FIG. 4) are bent to the outside of the packaging box 1. In this way, the handle part 21*a* of the packaging box 1 is exposed from an opening (a product outlet) positioned at one end side of the packaging box 1. A worker grasps the handle part 21*a* with his/her hand and takes the toner cartridge 20 out of the packaging box 1. Furthermore, in order to open the one end side of the packaging box 1 and then block the one end side again, the worker bends the flap 4*a* and the flap 4*b* in this order and allows the engagement piece 8*b* to be engaged with the engagement hole 8*a*.

As described above, the worker grasps the handle part 21*a* when taking the toner cartridge 20 out of the packaging box 1, so that it is possible to facilitate a mounting work of the toner cartridge 20 to an image forming apparatus, which is performed subsequently to the above work.

However, when the worker erroneously takes the toner cartridge 20 out of the other end side opening opposite to the one end side opening which is a prescribed product outlet, the worker needs to grasp the driving connection part 22 of the toner cartridge 20 with his/her hand and to perform the taking-out of the toner cartridge 20. Therefore, in the mounting work of the toner cartridge 20 to an image forming apparatus, which is subsequently performed, the worker needs to change a holding position of the toner cartridge 20 from the driving connection part 22 to the handle part 21*a*. As a consequence, there is a problem that facilitation of work is damaged.

Figure 6:
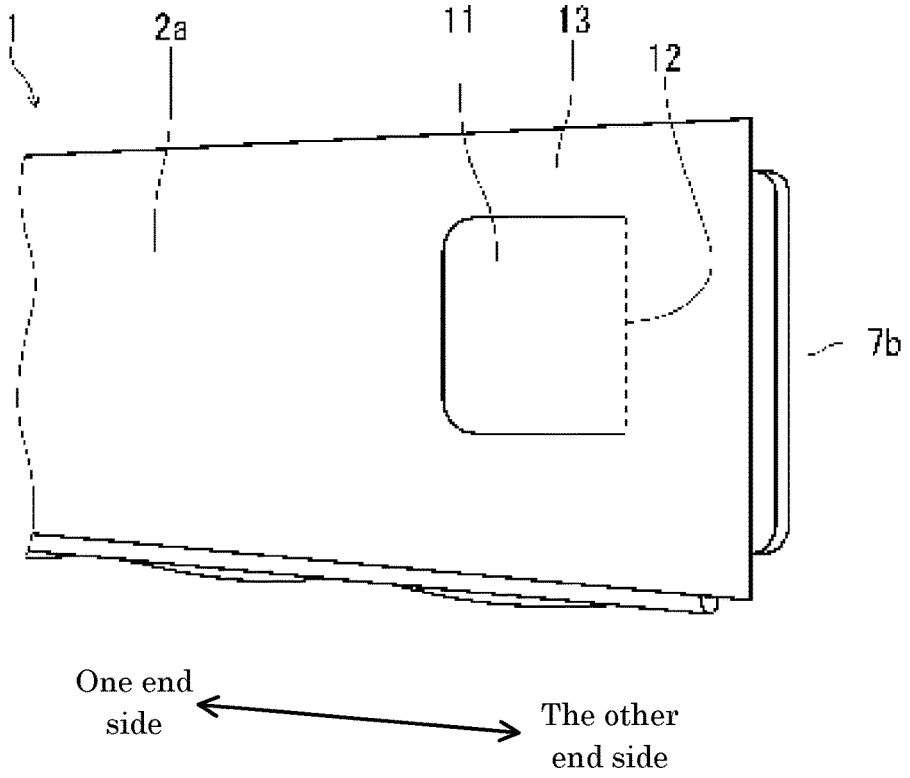
FIG. 6 is an enlarged perspective view illustrating a part provided with a bending piece at the other end part in a longitudinal direction of a packaging box.

In this regard, in the present embodiment, as illustrated in FIG. 6, the bending piece 11 is formed at the other side end part in the longitudinal direction of the handle part 21*a* of the packaging box 1. The bending piece 11 is a part surrounded by a bending line 12 extending in a direction perpendicular to the longitudinal direction of the packaging box 1 and a channel-shaped (U-shaped) breakable line 13 opened to the other side in the longitudinal direction.

Figure 7:
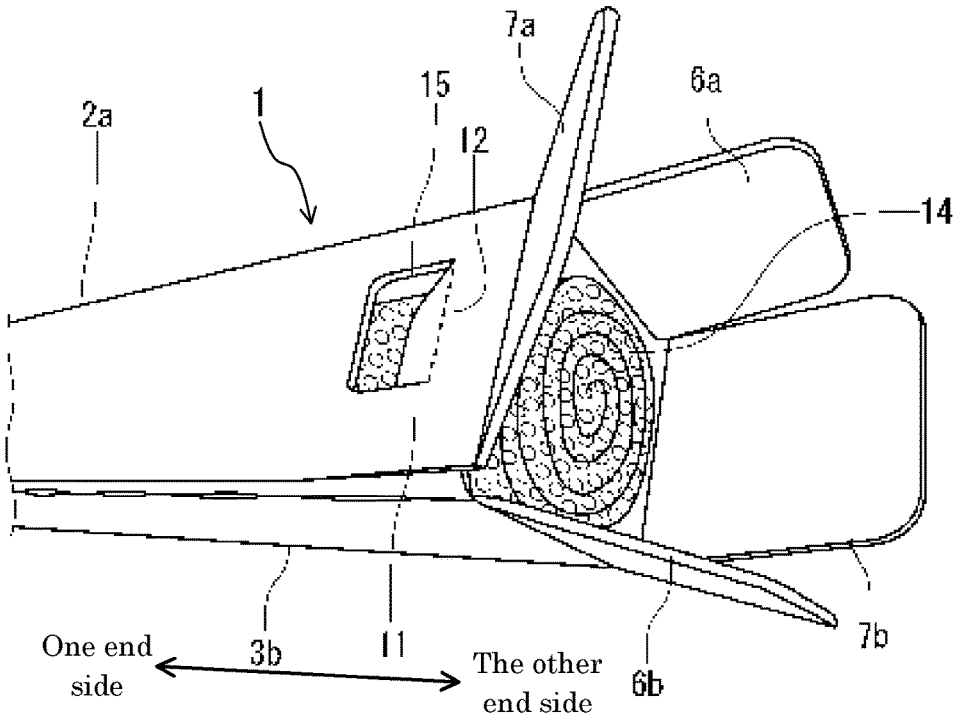
FIG. 7 is a perspective view illustrating a state in which a cover part of the other end part in a longitudinal direction of a packaging box is opened and a bending piece is bent.

The bending piece 11 is pressed from the outside of the box and thus is bent to the inside of the box by employing the bending line 12 as a fulcrum. The bending piece 11 is provided to a part corresponding to a buffer material filling area of the other end side from the area where the toner cartridge 20 is received in the packaging box 1. Since the bubble-containing buffer material 14 is filled in the buffer material filling area, when the bending piece 11 is bent as illustrated in FIG. 7, the bubble-containing buffer material 14 is visible through a rectangular opening 15 (an opening) from the outside of the packaging box 1.

Figure 8:
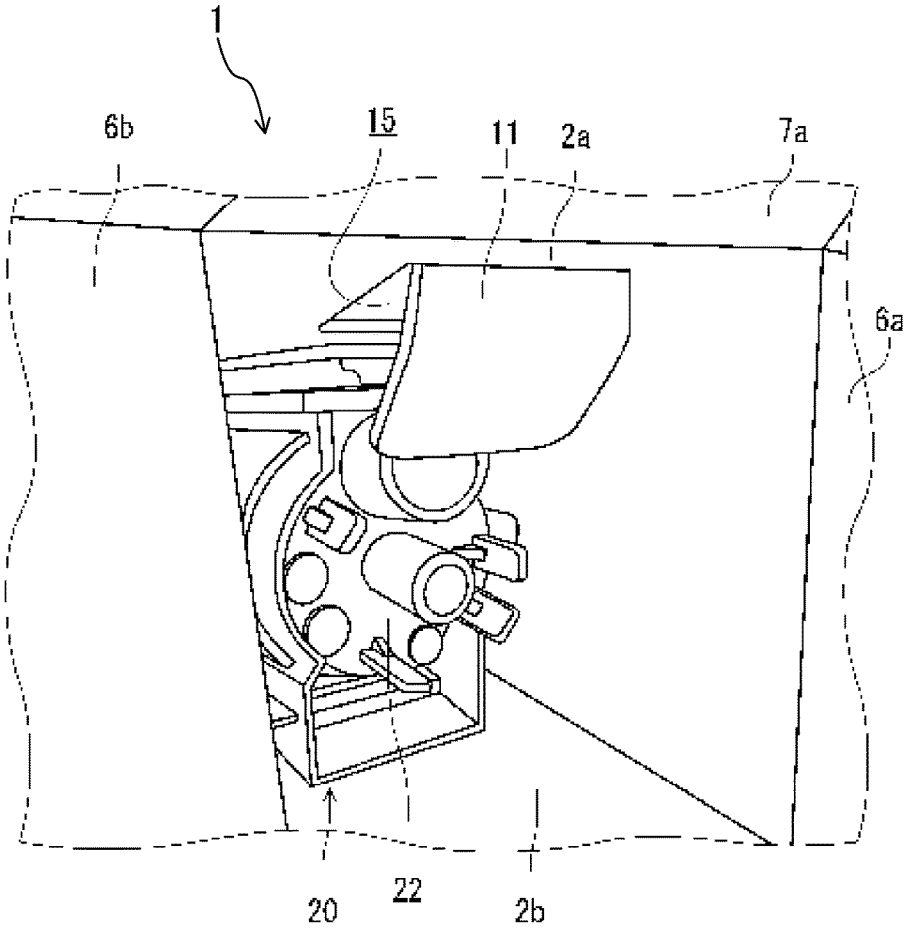
FIG. 8 is a perspective view when an interior of a packaging box is viewed from the other end part side in a longitudinal direction.

As illustrated in FIG. 8, the bending piece 11 is formed such that its distal end part is positioned at an outer side (the other end side of the packaging box 1) from the receiving area of the toner cartridge 20 when the bending piece 11 has been bent to the inside of the box.

According to the packaging box 1 configured as described above, when a worker presses the bending piece 11 to be bent to the inside of the box, even though the worker intends to take the toner cartridge 20 out of the other end side opening (the opening opposite to the product outlet) of the packaging box 1, an end surface of the toner cartridge 20 is hooked to the distal end part of the bending piece 11 (see FIG. 8). Consequently, since the movement of the toner cartridge 20 is inhibited by the bending piece 11, the worker can see that the taking-out direction of the toner cartridge 20 is erroneous.

Furthermore, the worker can see the bubble-containing buffer material 14 from the rectangular opening 15 (see FIG. 7 and FIG. 8) formed when the bending piece 11 has been bent. Consequently, the worker can distinguish the bubble-containing buffer material 14 (a noncombustible) from the packaging box 1 (a combustible) for the purpose of disposal.

Furthermore, even though the packaging box 1 is received in the assembly box 100 approximately without a gap as with the present embodiment, the worker can easily take the packaging box 1 out of the assembly box 100 by inserting his/her finger into the rectangular opening 15 formed by pressing the bending piece 11.

What is claimed is:

1. A packaging form using a packaging box, the packaging box comprising:

a tubular side plate that covers a periphery of an object to be packaged;

one end side-blocking plate that blocks an opening of one end side, which constitutes an outlet of the object to be packaged in the tubular side plate; and the other end side-blocking plate that blocks an opening of the other end side opposite to the one end side, wherein a bending piece is provided at an end part of the other end side of the tubular side plate, and is pressed while being surrounded by a breakable line and a bending line so as to be broken and bent to an inside of the box along the breakable line, wherein, in the bending state, the bending piece is configured such that a distal end part of the bending piece is positioned at the other end side from a receiving area of the object to be packaged and inhibits movement of the object to be packaged to the other end side, wherein a bubble-containing buffer material is filled in a part corresponding to the bending piece at a side of the other end side-blocking plate of the packaging box, and wherein a toner cartridge, which includes a driving connection part at one side end part in a longitudinal direction of a hollow cylindrical case storing printing toner and a handle part at the other side end part in the longitudinal direction of the case, is received in the packaging box such that the driving connection part faces the bubble-containing buffer material and the handle part faces the one end side-blocking plate.

2. The packaging form of claim 1, wherein the bending piece is configured to allow the buffer material to be visible from an opening formed when the bending piece is bent.

3. The packaging form of claim 1, wherein the one end side-blocking plate is provided with a belt-like part interposed between a pair of breakable lines for opening.

* * * * *